US011668299B2

(12) United States Patent
Kang

(10) Patent No.: US 11,668,299 B2
(45) Date of Patent: Jun. 6, 2023

(54) VARIABLE OIL PUMP

(71) Applicants: HYUNDAI MOTOR COMPANY, Seoul (KR); KIA CORPORATION, Seoul (KR)

(72) Inventor: DongHoon Kang, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/507,378

(22) Filed: Oct. 21, 2021

(65) Prior Publication Data

US 2022/0316472 A1 Oct. 6, 2022

(30) Foreign Application Priority Data

Mar. 30, 2021 (KR) ..... 10-2021-0040937

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 14/22*** | (2006.01) |
| ***F04C 14/04*** | (2006.01) |
| ***F04C 2/344*** | (2006.01) |

(52) U.S. Cl.

CPC ..... *F04C 14/226* (2013.01); *F04C 2/3441* (2013.01); *F04C 14/04* (2013.01); *F04C 14/223* (2013.01)

(58) Field of Classification Search

CPC ..... F04C 2/344; F04C 2/3441; F04C 14/04; F04C 14/22; F04C 14/223; F04C 14/226

See application file for complete search history.

(56) References Cited

U.S. PATENT DOCUMENTS 4,531,893 A * 7/1985 Okoh ..... F04C 14/226 418/30

2008/0175724 A1* 7/2008 Shulver ..... F04C 14/226 418/30

(Continued)

FOREIGN PATENT DOCUMENTS

CN 103671093 A * 3/2014 ..... F04C 14/22

OTHER PUBLICATIONS

CN 103671093A—Luo Yulong et al.—Displacement Variable Impeller Pump—Mar. 26, 2014—machine English Translation (Year: 2014).*

*Primary Examiner* — Theresa Trieu

(74) *Attorney, Agent, or Firm* — McDonnell Boehnen Hulbert & Berghoff LLP

(57) ABSTRACT

A variable hydraulic pump include a rotor mounted on a pump housing of which a housing spring end is formed, a pivot pin, an outer ring rotatably coupled to the pivot pin and of which a ring spring end is formed, a spring mounted between the housing spring end and the ring spring end, a pressure chamber formed in the pump housing to push the outer ring, a plurality of vane provided to form a plurality of pockets, an input port to supply oil to the plurality of pockets and a discharge port to exhaust oil supplied to the plurality of pockets, wherein at the reference position of the outer ring, the angle between a first imaginary line connecting the center of the rotor and the pivot pin and a second imaginary line connecting the ring spring end and the pivot pin is 0 to 10 degrees.

5 Claims, 5 Drawing Sheets

(56) References Cited

U.S. PATENT DOCUMENTS

| | | | | |
|---|---|---|---|---|
| 2010/0014991 | A1* | 1/2010 | Pryor | F04C 14/226<br>418/30 |
| 2014/0219847 | A1* | 8/2014 | Watanabe | F04C 14/226<br>418/24 |

* cited by examiner

VARIABLE OIL PUMP

CROSS REFERENCE TO RELATED APPLICATIONS

This application claims priority to and the benefit of Korean Patent Application No. 10-2021-0040937 filed in the Korean Intellectual Property Office on Mar. 30, 2021, the entire contents of which are incorporated herein by reference.

BACKGROUND

(a) Field

The present disclosure relates to a variable hydraulic pump. More particularly, the present disclosure relates to a variable hydraulic pump capable of stably maintaining oil pressure even in a high-speed section.

(b) Description of the Related Art

A variable hydraulic pump is a configuration that adjusts the discharge flow for an enhancement of fuel efficiency.

The discharge capacity of a variable hydraulic pump is determined by the volume of the pocket formed by the rotor, the outer ring, and the vane, and the volume of the pocket is adjusted according to the position of the outer ring with respect to the pivot pin.

When pressure is formed in the pressure chamber, the outer ring rotates with respect to the pivot pin while overcoming the variable spring reaction force with the force generated by the pressure.

When the outer ring rotates around the pivot pin, the volume of the pocket is reduced and the hydraulic pump capacity can be reduced.

However, in a general variable hydraulic pump, in a high-speed section (e.g., 4000 rpm or more), the outer ring moves by itself even when the pressure of the pressure chamber is not applied, reducing the capacity of the variable hydraulic pump.

Due to the reduced capacity, low oil pressure is formed in the high-speed section, which can cause problems in engine durability.

The oil pressure decreased even when no pressure was applied to the pressure chamber because the outer ring overcomes the reaction force of the spring due to an external cause and moves by itself, reducing the hydraulic pump capacity.

Here, the external cause means an increase in oil temperature, deterioration in viscosity due to severe driving conditions and the like.

To prevent this, a robust design is required so that the outer ring does not move even in severe driving conditions.

Design factors related to the behavior of the outer ring include many factors such as spring reaction force, discharge port shape, pocket pressure and the like.

Here, the spring reaction force refers to the force that resists the movement of the outer ring moving with respect to the pivot pin, and the spring reaction force is determined by the spring constant, free field length, mount length, etc. However, these spring specifications are generally difficult to change because they are closely related to other performance factors.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a variable hydraulic pump that can stably maintain oil pressure even in a high-speed section.

A variable hydraulic pump according to an exemplary embodiment of the present disclosure may include a rotor mounted on a pump housing, the pump housing having a housing spring end, a pivot pin mounted to the pump housing, an outer ring rotatably coupled to the pivot pin, the outer ring having a ring spring end, a spring mounted between the housing spring end and the ring spring end to elastically support the outer ring, a pressure chamber formed in the pump housing to push the outer ring according to the pressure formed therein, a plurality of vane provided to form a plurality of pockets between the rotor and the outer ring, an input port formed to the pump housing to supply oil to the plurality of pockets, and a discharge port formed to the pump housing to exhaust oil supplied to the plurality of pockets, wherein at the reference position of the outer ring, the angle between a first imaginary line connecting the center of the rotor and the pivot pin and a second imaginary line connecting the ring spring end and the pivot pin may be 0 to 10 degrees.

At the reference position of the outer ring, the angle between a third imaginary line passing through the center of the spring and a fourth imaginary line connecting the center of the outer ring and the center of the rotor may be −5 to +5 degrees.

The discharge port may include a first discharging point that is a formation starting position and a second discharging point that is a formation last position, and wherein the first discharging point may be formed at a position further away from the end of the input port by a predetermined angle than the position corresponding to the pocket with respect to the center of the rotor.

The predetermined angle may be 4 degrees to 6 degrees.

The second discharging point may be formed at 115 to 125 degrees from the first discharging point with respect to the center of the rotor.

The pivot pin may be mounted at a position corresponding to 35% to 45% between the first discharging point and the second discharging point.

According to the variable hydraulic pump according to an exemplary embodiment of the present disclosure, it is possible to stably maintain the oil pressure even in a high-speed section, and thereby improve engine durability.

In addition, for the effects that can be obtained or predicted due to an exemplary embodiment of the present disclosure, it is to be disclosed directly or implicitly in the detailed description of an exemplary embodiment of the present disclosure. That is, various effects predicted according to an exemplary embodiment of the present disclosure will be disclosed within a detailed description to be described later.

BRIEF DESCRIPTION OF THE FIGURES

Since these drawings are for reference in explaining an exemplary embodiment of the present disclosure, the technical idea of the present disclosure should not be construed as being limited to the accompanying drawings.

DETAILED DESCRIPTION

Figure 1:
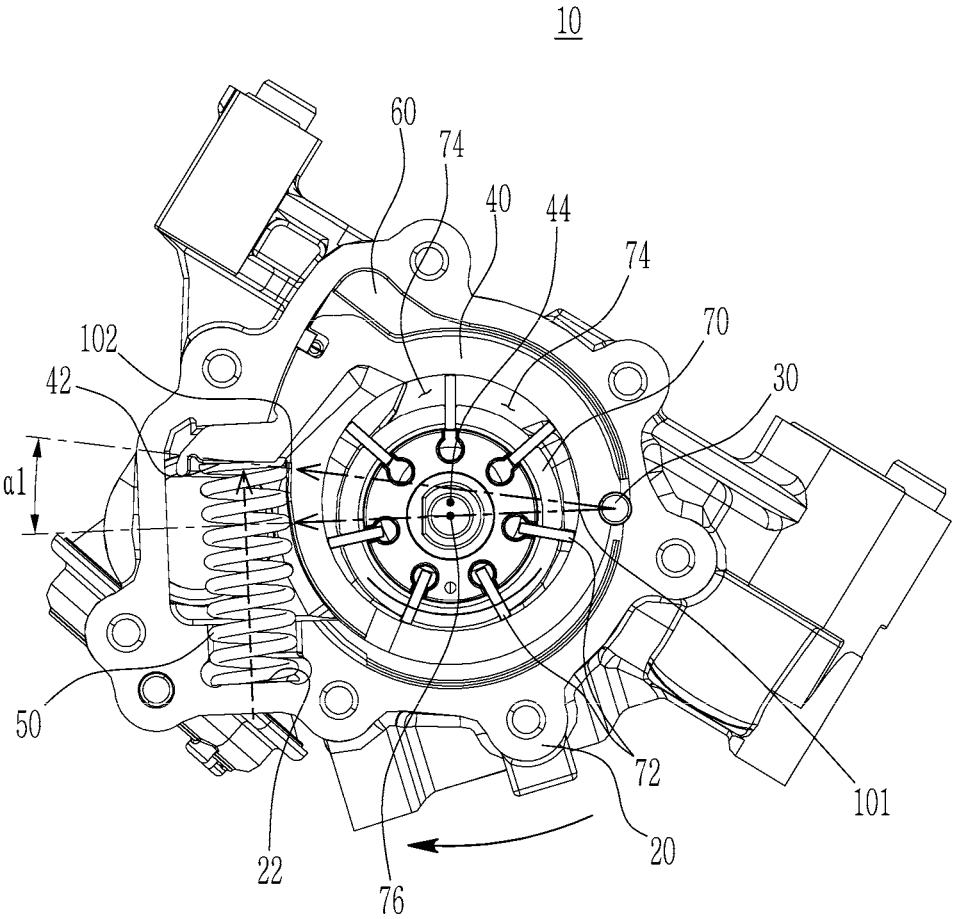
FIG. 1 and FIG. 2 are a partial front views of a variable hydraulic pump according to an exemplary embodiment of the present disclosure.

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

In order to clearly explain the present disclosure, parts irrelevant to the description are omitted, and the same reference numerals are assigned to the same or similar elements throughout the specification.

Since the size and thickness of each component shown in the drawings are arbitrarily indicated for convenience of description, the present disclosure is not necessarily limited to that shown in the drawings, and the thickness is enlarged to clearly express various parts and regions.

In addition, in the following detailed description, the names of the components are divided into first, second, and the like to distinguish them in the same relationship, and the order is not necessarily limited in the following description.

Throughout the specification, when a part includes a certain component, it means that other components may be further included, rather than excluding other components, unless otherwise stated.

In addition, terms such as . . . part, . . . means described in the specification mean a unit of a comprehensive configuration that performs at least one function or operation.

An exemplary embodiment of the present disclosure will hereinafter be described in detail with reference to the accompanying drawings.

Figure 2:
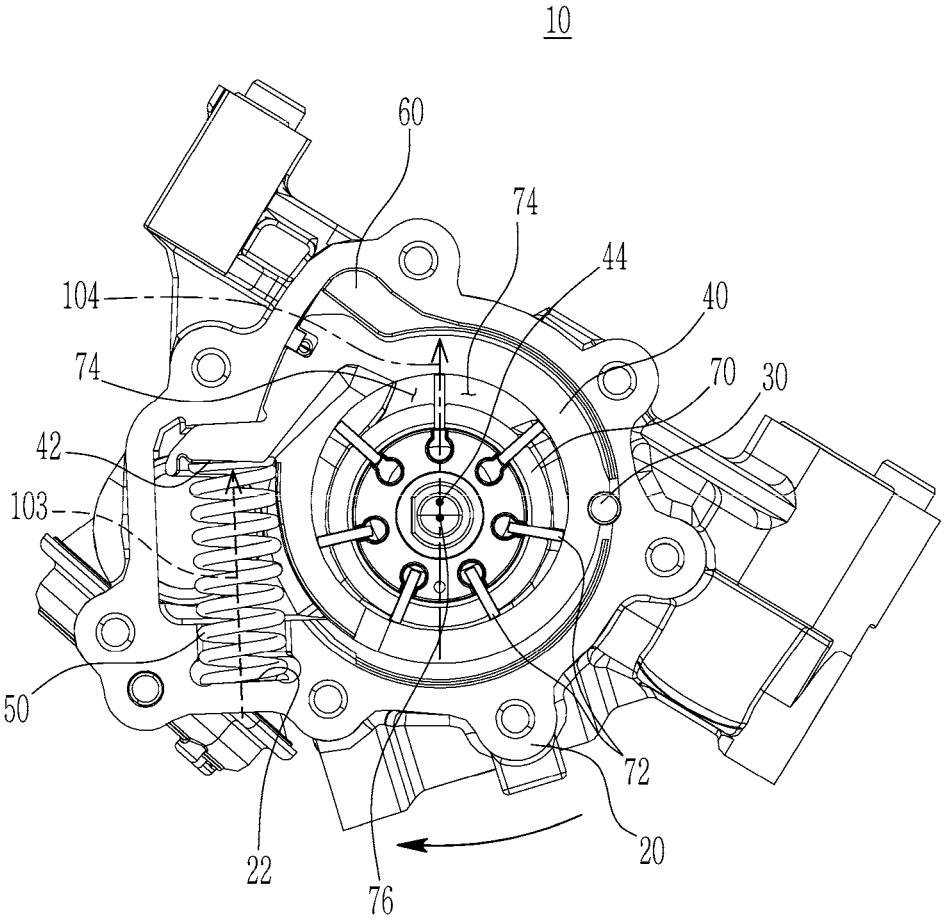

FIG. 1 and FIG. 2 are partial front views of a variable hydraulic pump according to an exemplary embodiment of the present disclosure.

For convenience of understanding, in FIG. 1 and FIG. 2, the cover of the hydraulic pump housing was removed.

Referring to FIG. 1, a variable hydraulic pump 10 according to an exemplary embodiment of the present disclosure may include a rotor 70 mounted on a pump housing 20 of which a housing spring end 22 is formed thereto, a pivot pin 30 mounted on the pump housing 20, an outer ring 40 that is rotatably coupled to the pivot pin 30 and of which a ring spring end 42 is formed thereto, a spring 50 mounted between the housing spring end 22 and the ring spring end 42 to elastically support the outer ring 40, a pressure chamber 60 formed in the pump housing 20 to push the outer ring 40 according to the pressure formed therein, and a plurality of vane 72 provided to form a plurality of pockets 74 between the rotor 70 and the outer ring 40.

Figure 3:
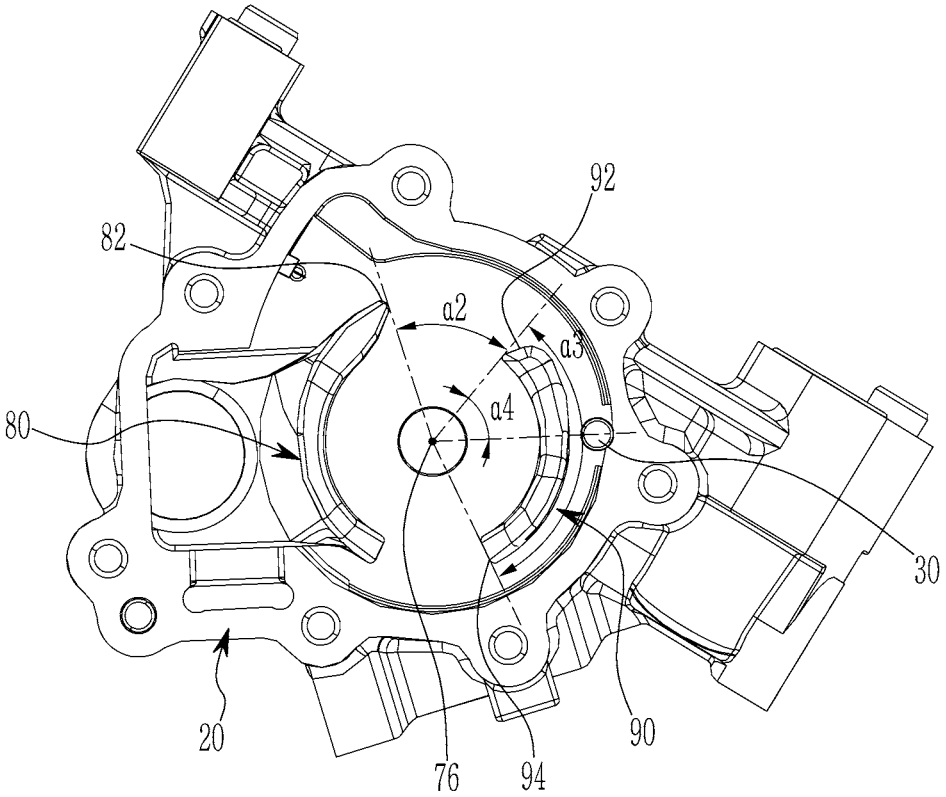
FIG. 3 is a partial front view with the rotor and outer ring removed of the variable hydraulic pump according to an exemplary embodiment of the present disclosure.

FIG. 3 is a partial front view with the rotor and outer ring removed of the variable hydraulic pump according to an exemplary embodiment of the present disclosure.

Referring to FIG. 1 and FIG. 3, the variable hydraulic pump 10 according to an exemplary embodiment of the present disclosure may include an input port 80 formed on the pump housing 20 to supply oil to the plurality of pockets 74, and a discharge port 90 formed in the pump housing 20 to exhaust the oil supplied from the plurality of pockets 74.

The pressure chamber 60 pushes the outer ring 40 with its internal pressure according to the rpm of the engine, and the outer ring 40 rotates about the pivot pin 30, for example, based on the drawing, will move counterclockwise.

The position of the outer ring 40 shown in FIG. 1 is defined as the reference position in the specification and claims, which is the position when the rotor 70 is not operating. The rotor 70 can rotate in conjunction with the engine.

A configuration in which the plurality of vane 72, the rotor 70 and the outer ring 40 form the plurality of pockets 74 and its operation are obvious to those skilled in the art, and thus a detailed description thereof will be omitted.

At the reference position of the outer ring 40, an angle al formed by a first imaginary line 101 connecting the center 76 of the rotor 70 and the pivot pin 30 and a second imaginary line 102 connecting the ring spring end 42 and the pivot pin 30 may be 0 to 10 degrees.

The spring reaction force refers to the force that resists the movement of the outer ring moving with respect to the pivot pin. The spring reaction force is determined by the spring constant, free field length, mount length and so on. However, these spring specifications are generally difficult to change because they are closely related to other performance factors.

In the variable hydraulic pump 10 according to an exemplary embodiment of the present disclosure, since the angle al formed by the first imaginary line 101 and the second imaginary line 102 is limited to 0 to 10 degrees, the spring 50 is not changed to a spring with high tension, and the force that the spring 50 supports the outer ring 40 can be maintained.

Referring to FIG. 2, in the reference position of the outer ring 40, an angle between the third imaginary line 103 passing through the center of the spring 50 and the fourth imaginary line 104 connecting the center 44 of the outer ring 40 and the center 76 of the rotor 70 may be −5 to +5 degrees.

In other words, if the center 44 of the outer ring 40 and the center 76 of the rotor 70 are positioned so that the third imaginary line 103 and the fourth imaginary line 104 are almost parallel, the spring 50 will maintain the force supporting the outer ring 40.

Referring to FIG. 3, the discharge port 90 includes a first discharging point 92 that is a formation starting position and a second discharging point 94 that is a formation last position. And the first discharging point 92 may be formed at a position a2 further away from an end 82 of the input port 80 by a predetermined angle than the position corresponding to one of the pockets 74 with respect to the center 76 of the rotor 70.

A position corresponding to one of the pockets 74 may be defined as an angle forming the one pocket 74. For example, in the drawings, seven vanes 72 form seven pockets 74, and the angle forming one pocket 74 may be about 51.4 ($^{360}/_{7}$) degrees.

The predetermined angle may be 4 to 6 degrees. Accordingly, the first discharging point 92 may be about 55.4 degrees to 57.4 degrees $\alpha 2$ from the end 82 of the input port 80 with respect to the center 76 of the rotor 70.

Therefore, the oil flowing in through the input port 80 can be properly compressed without leakage and exhausted through the discharge port 90.

The variable hydraulic pump 10 according to an exemplary embodiment of the present disclosure is described as including seven pockets, but is not limited thereto, and may also be applied to a variable hydraulic pump including a variable number of pockets according to the size and design specifications of the variable hydraulic pump.

For example, in a case where a variable hydraulic pump has six pockets, the position corresponding to each pocket may be 60 ($^{360}/_{6}$) degrees, and in this case, the first discharging point is about 64 to 66 degrees from the end of the input port with respect to the center of the rotor.

The second discharging point 94 may be formed from the first discharging point 92 to 115 degrees to 125 degrees $\alpha 3$ with respect to the center 76 of the rotor 70. That is, the discharge port 90 is formed approximately 120 degrees with respect to the center 76 of the rotor 70 so that oil cam be smoothly discharged.

The pivot pin 30 may be mounted at a position corresponding to 35% to 45% between the first discharging point 92 and the second discharging point 94.

That is, the pivot pin 30 can be positioned at approximately 50 degrees $\alpha 4$ from the first discharging point 92 with respect to the center 76 of the rotor 70.

The variable hydraulic pump 10 according to an exemplary embodiment of the present disclosure may maintain the force of the spring 50 supporting the outer ring 40 without changing the spring 50 by changing the position of the pivot pin 30.

Figure 4:
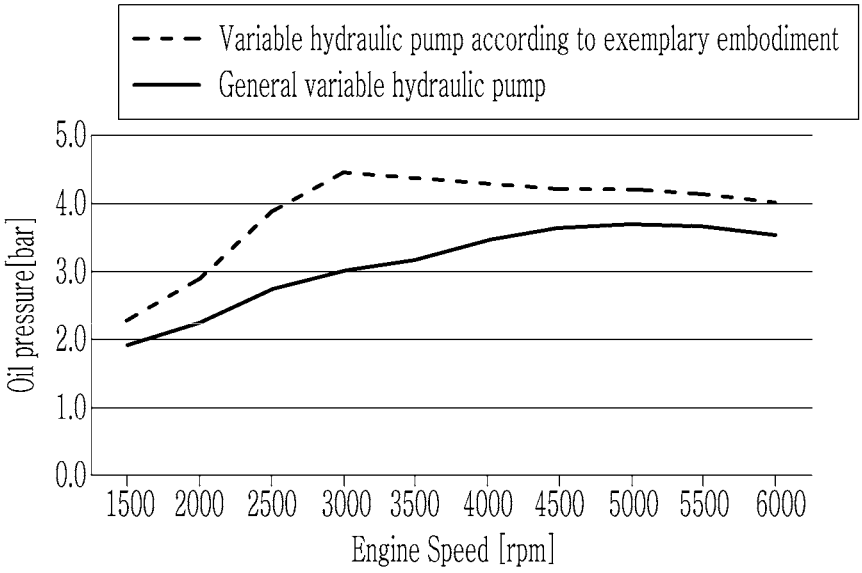
FIG. 4 is a drawing comparing the oil pressure of a variable hydraulic pump according to an exemplary embodiment of the present disclosure.

FIG. 4 is a drawing comparing the oil pressure of a variable hydraulic pump according to an exemplary embodiment of the present disclosure.

In a general variable hydraulic pump, in a high-speed section (e.g., 4000 rpm or more), the outer ring moves by itself even when the pressure of the pressure chamber is not applied, thereby reducing the capacity of the variable hydraulic pump. For example, the outer ring overcomes the reaction force of the spring and moves by itself due to oil temperature rise and viscosity deteriorated due to severe driving conditions, thereby reducing the hydraulic pump capacity.

However, in the experiment result using the same spring of the same capacity, the variable hydraulic pump 10 according to an exemplary embodiment of the present disclosure maintains an appropriate oil pressure compared to a general variable hydraulic pump.

Here, the variable hydraulic pump 10 according to an exemplary embodiment of the present disclosure has been experimented with the case where the angle $\alpha 1$ formed by the first imaginary line 101 and the second imaginary line 102 is about 9 degrees, and the corresponding angle of the general variable hydraulic pump is about 24.

Figure 5:
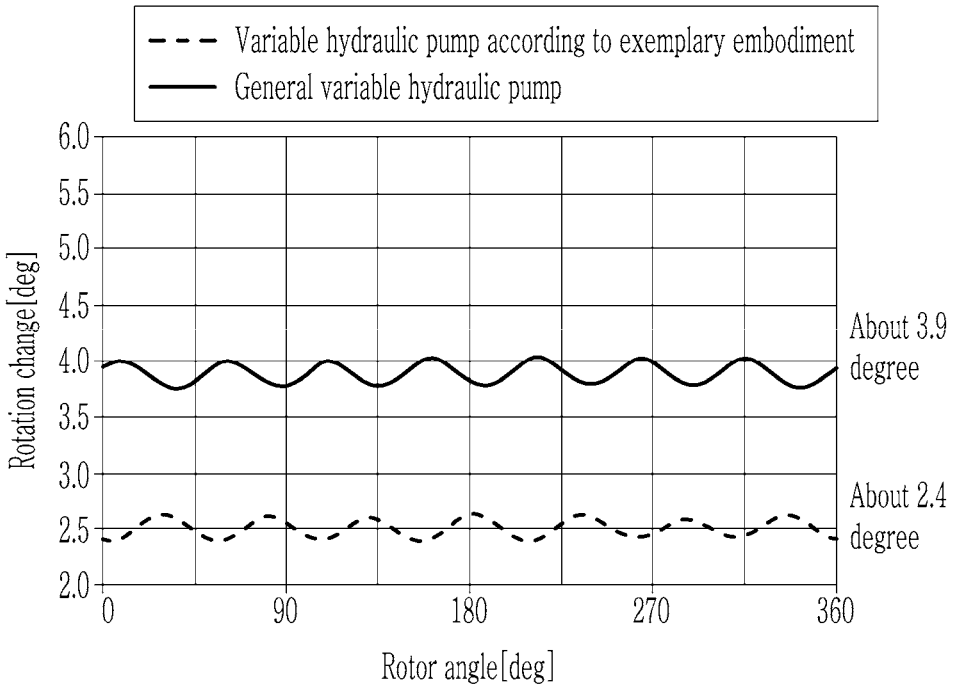
FIG. 5 is a drawing comparing the rotation change of the outer ring of a variable hydraulic pump according to an exemplary embodiment of the present disclosure.

FIG. 5 is a drawing comparing the rotation change of the outer ring of a variable hydraulic pump according to an exemplary embodiment of the present disclosure.

Referring to FIG. 5, in the same external condition, the rotation change of the outer ring 40 of the variable hydraulic pump 10 according to an exemplary embodiment of the present disclosure and the rotation change of the outer ring of a general variable hydraulic pump were experimented.

As shown in FIG. 5, it was confirmed that the change of the outer ring 40 of the variable hydraulic pump 10 by an exemplary embodiment of the present disclosure was smaller than the change of the outer ring of the general variable hydraulic pump.

That is, the outer ring 40 of the variable hydraulic pump 10 according to an exemplary embodiment of the present disclosure operates more stably.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

The invention claimed is:

1. A variable hydraulic pump comprising:

a rotor mounted on a pump housing, the pump housing having a housing spring end;

a pivot pin mounted to the pump housing;

an outer ring rotatably coupled to the pivot pin, the outer ring having a ring spring end;

a spring mounted between the housing spring end and the ring spring end to elastically support the outer ring;

a pressure chamber formed in the pump housing, the pressure chamber being configured to push the outer ring according to the pressure formed therein;

a plurality of vanes forming a plurality of pockets between the rotor and the outer ring;

an input port formed in the pump housing to supply oil to the plurality of pockets; and a discharge port formed in the pump housing to exhaust oil supplied to the plurality of pockets;

wherein at a reference position of the outer ring, an angle between a first imaginary line connecting a center of the rotor and the pivot pin and a second imaginary line connecting the ring spring end and the pivot pin is 0 to 10 degrees; and wherein at the reference position of the outer ring, an angle between a third imaginary line passing through a center of the spring and a fourth imaginary line connecting a center of the outer ring and the center of the rotor is −5 to +5 degrees.

2. The variable hydraulic pump of claim 1, wherein, the discharge port includes a first discharging point that is a formation starting position and a second discharging point that is a formation last position; and wherein the first discharging point is formed at a position further away from an end of the input port by a predetermined angle than the position corresponding to one pocket of the plurality of pockets with respect to the center of the rotor.

3. The variable hydraulic pump of claim 2, wherein the second discharging point is formed at 115 to 125 degrees from the first discharging point with respect to the center of the rotor.

4. The variable hydraulic pump of claim 3, wherein the pivot pin is mounted at a position corresponding to 35% to 45% between the first discharging point and the second discharging point.

5. A variable hydraulic pump comprising:

a rotor mounted on a pump housing, the pump housing having a housing spring end;

a pivot pin mounted to the pump housing;

an outer ring rotatably coupled to the pivot pin, the outer ring having a ring spring end;

a spring mounted between the housing spring end and the ring spring end to elastically support the outer ring;

a pressure chamber formed in the pump housing, the pressure chamber being configured to push the outer ring according to the pressure formed therein;

a plurality of vanes forming a plurality of pockets between the rotor and the outer ring;

an input port formed in the pump housing to supply oil to the plurality of pockets; and a discharge port formed in the pump housing to exhaust oil supplied to the plurality of pockets;

wherein at a reference position of the outer ring, an angle between a first imaginary line connecting a center of the rotor and the pivot pin and a second imaginary line connecting the ring spring end and the pivot pin is 0 to 10 degrees;

wherein, the discharge port includes a first discharging point that is a formation starting position and a second discharging point that is a formation last position; and wherein the first discharging point is formed at a position further away from an end of the input port by a predetermined angle than the position corresponding to one pocket of the plurality of pockets with respect to the center of the rotor; and wherein the predetermined angle is 4 degrees to 6 degrees.

* * * * *